US012680704B2

(12) United States Patent
Fulda

(10) Patent No.: US 12,680,704 B2
(45) Date of Patent: Jul. 14, 2026

(54) PACKAGED TERMINAL AIR CONDITIONER (PTAC) WITH AN INTEGRATED ENERGY RECOVERY VENTILATOR (ERV) OR HEAT RECOVERY VENTILATOR (HRV)

(71) Applicant: Yehuda Fulda, Beit Shemesh (IL)

(72) Inventor: Yehuda Fulda, Beit Shemesh (IL)

( * ) Notice: Subject to any disclaimer, the term of this patent is extended or adjusted under 35 U.S.C. 154(b) by 253 days.

(21) Appl. No.: 18/136,880

(22) Filed: Apr. 20, 2023

(65) Prior Publication Data

US 2023/0250973 A1 Aug. 10, 2023

Related U.S. Application Data

(60) Provisional application No. 63/334,213, filed on Apr. 25, 2022.

(51) Int. Cl.
*F24F 1/16* (2011.01)
*F24F 1/38* (2011.01)

(52) U.S. Cl.
CPC . *F24F 1/16* (2013.01); *F24F 1/38* (2013.01)

(58) Field of Classification Search
CPC ..... F24F 1/16; F24F 1/38; F24F 1/029; F24F 1/0323
USPC ..... 62/42, 428
See application file for complete search history.

(56) References Cited

U.S. PATENT DOCUMENTS

2020/0278128 A1* 9/2020 Patel ..... F24F 1/037
2021/0199315 A1* 7/2021 Chen ..... F24F 1/022

* cited by examiner

*Primary Examiner* — Steve S Tanenbaum

(57) ABSTRACT

The present invention relates to a novel packaged terminal air conditioner (PTAC) system with an integrated energy recovery ventilator (ERV) unit or a heat recovery ventilator (HRV) unit. The integration of the ERV/HRV unit within the PTAC ensures lowering the work load of the compressor that would otherwise consume lot of power to cool/heat the room or any living space.

11 Claims, 7 Drawing Sheets

PACKAGED TERMINAL AIR CONDITIONER (PTAC) WITH AN INTEGRATED ENERGY RECOVERY VENTILATOR (ERV) OR HEAT RECOVERY VENTILATOR (HRV)

CROSS-REFERENCE TO RELATED PATENT DOCUMENTS

This patent application claims the benefit of priority of U.S. Provisional Application No. 63/334,213 entitled "PACKAGED TERMINAL AIR CONDITIONER (PTAC) WITH AN INTEGRATED ENERGY RECOVERY VENTILATOR (ERV) OR HEAT RECOVERY VENTILATOR (HRV)," filed 25 Apr. 2022, which is hereby incorporated herein by reference in its entirety.

TECHNICAL FIELD

This invention relates generally to the field of air conditioner systems, and more particularly to a power-efficient packaged terminal air conditioner (PTAC) system. Specifically, the present invention relates to a PTAC system with an integrated energy recovery ventilator (ERV) unit or a heat recovery ventilator (HRV) unit that provides more power efficiency.

BACKGROUND

Packaged terminal air conditioning (PTAC) systems are well known and widely used in commercial buildings (such as hotels) to adjust the temperature indoors. PTAC systems are self-contained air conditioning and heat units designed to heat and cool a limited space. Although PTACs are self-contained, they include both an indoor portion and an outdoor portion separated usually by an intermediate separation wall. PTACs often need to draw air from the outdoor portion into the indoor portion. PTAC systems are installed on the exterior wall or windows of the building such that the air inlet portion of the system generally projects outward beyond the outer wall of the building and the air venting portion of the system is positioned inward through the interior wall of the building. Generally, the heating and cooling mechanism is housed within a sleeve/housing. PTAC also includes a closed refrigeration loop to heat or cool the indoor air of the living space. Typically, the indoor air is recirculated while being heated or cooled using a typical PTAC system. The compressor/heat pump plays an important role and does most of the work (resulting in more power consumption) of taking in outdoor air and then performing necessary cooling and heating on this drawn air in order to pass on the resultant conditioned air in the room or living space via the air venting portion of the system.

Some of the inventors in the past have proposed solutions in order to decrease the work done by compressor/heat pump so as to save the power consumption that a typical PTAC with the heat pump consumes. US20190316807 discloses an HVAC system having a heat pump integrated with an energy recovery ventilator (ERV) or heat recovery ventilator (HRV) to meet additional air conditioning requirements within the room or building. The HVAC system as disclosed includes a heat pump comprising a housing, and an energy recovery ventilator (ERV) or heat recovery ventilator (HRV) integrated with the heat pump such that an access panel to the ERV faces outwardly from the housing of the heat pump, and such that the access panel is accessible at an outer boundary of the housing. A similar integration of the ERV or HRV with the heat pump of a vertically oriented HVAC system is disclosed in US20130017774.

Inspired by the same concept, the inventor herein proposes to integrate ERV or HRV unit within the PTAC system. The inventor herein proposes a novel configuration for the traditional PTAC that would allow easy integration of the ERV or HRV unit within the PTAC system (relatively horizontal air conditioning system) such as to decrease the work done by the heat pump/compressor and/or decrease the overall power consumption of the air conditioning system which would otherwise be much more.

BRIEF SUMMARY

The present invention has been designed to address the issue discussed above, with an object of the present invention to provide a novel configuration for the components housed within the traditional PTAC system.

Another object of the present invention is to provide an improved and more efficient PTAC system including an ERV or HRV unit that would significantly reduce the overall power consumption which would otherwise have been consumed by a typical PTAC using just the compressor or heat pump.

The amount of outdoor air needed for providing proper air conditioning within the room where PTAC is installed will depend on a variety of factors, such as the number of room occupants, the size of the room, etc. The requirement of more air conditioning within the room will force the compressor or heat pump to work more and thus result in more power consumption. The strategic placement of ERV or HRV within the PTAC without sacrificing the advantages associated with the PTAC will benefit the room occupants because ERV will add to the working efficiency of the PTAC and reduce overall power consumption by lowering the load on the compressor present in the PTAC.

The presented solution of integrating ERV or HRV within the PTAC's housing in order to overcome the higher power consumption requirement of the typical PTAC is going to be less complex and economical, less noisy, and will be easy to install and maintain.

According to an embodiment of the present invention, there is provided a packaged terminal air conditioner (PTAC) system that includes an indoor portion; and an outdoor portion. The outdoor portion embodied inside a sleeve, the outdoor portion comprising at least a backplate with a cut-out section, an outdoor fan mounted on the cut-out section, an outdoor heat exchanger configured at an angle with a first end associated thereof laid proximal to a first end of an intermediate wall separating an indoor portion and the outdoor portion, and a second end associated thereof laid proximal to the backplate, a compressor, and associated refrigerant flow lines, and an ERV/HRV unit.

In an embodiment, the angular placement of the outdoor heat exchanger, and the backplate-mounted outdoor leaves a space (S) within the outdoor portion. The compressor and associated refrigerant flow lines are positioned within the space (S). The space (S) further facilitates in accommodation of the ERV/HRV unit within the outdoor portion. The integration of the ERV/HRV unit within the outdoor portion ensures lowering of the workload of the compressor to cool or heat a living space, thereby reducing the overall power consumption of the PTAC system. The angular placement of the outdoor heat exchanger may range from 20 degrees to 60 degrees.

In an embodiment, the PTAC system further comprises a rear grill with a plurality of openings (108*a*).

In an embodiment, the backplate comprises an opening to allow outdoor fresh air to enter the outdoor portion (204). The outdoor fresh air entering the outdoor portion through the opening cools the compressor.

In an embodiment, the outdoor fan is an exhaust fan able to draw air from the outdoor portion and throw it outside.

In an embodiment, the indoor portion comprises a front cover adapted for concealing at least an indoor heat exchanger, an indoor fan, and a heating element located in the indoor portion.

In an embodiment, the compressor and associated flow lines are positioned in between the outdoor heat exchanger and the intermediate wall.

In an embodiment, the outdoor portion comprises a separation wall separating the ERV/HRV unit from the compressor and associated flow lines.

In an embodiment, the ERV/HRV unit is operational along with the compressor in order to adjust the air conditioning requirement of the living space. The ERV/HRV unit ensures less working load on the compressor by preheating or precooling the outdoor air entering the room by passing through a core embodied there inside.

Various advantages and features of the present invention are described herein with specificity so as to make the present invention understandable to one of ordinary skill in the art, both with respect to how to practice the present invention and how to make the present invention.

BRIEF DESCRIPTION OF THE DRAWINGS

The above set forth and other features of the present invention are made more apparent in the ensuing description of the preferred embodiments when read in conjunction with the attached drawings, wherein.

DETAILED DESCRIPTION

Certain terminology is used in the following description for reference only and is not limiting. Unless specifically set forth herein, the terms "a," "an," and "the" are not limited to one element, but instead should be read as meaning "at least one." The terminology includes the words noted above, derivatives thereof, and words of similar import. Before describing the present invention in detail, it should be observed that the present invention utilizes a combination of components, which constitutes a novel configuration for a PTAC system with an integrated energy recovery ventilator (ERV) or heat recovery ventilator (HRV) unit. Accordingly, the components have been represented, showing only specific details that are pertinent for an understanding of the present invention so as not to obscure the disclosure with details that may be readily apparent to those with ordinary skill in the art having the benefit of the description herein. As required, the detailed embodiments of the present invention are disclosed herein. However, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The words "comprising", "having", "containing", and "including", and other forms thereof, are intended to be equivalent in meaning and be open-ended in that an item or items following any one of these words is not meant to be an exhaustive listing of such item or items or meant to be limited to only the listed item or items.

Figure 1A:
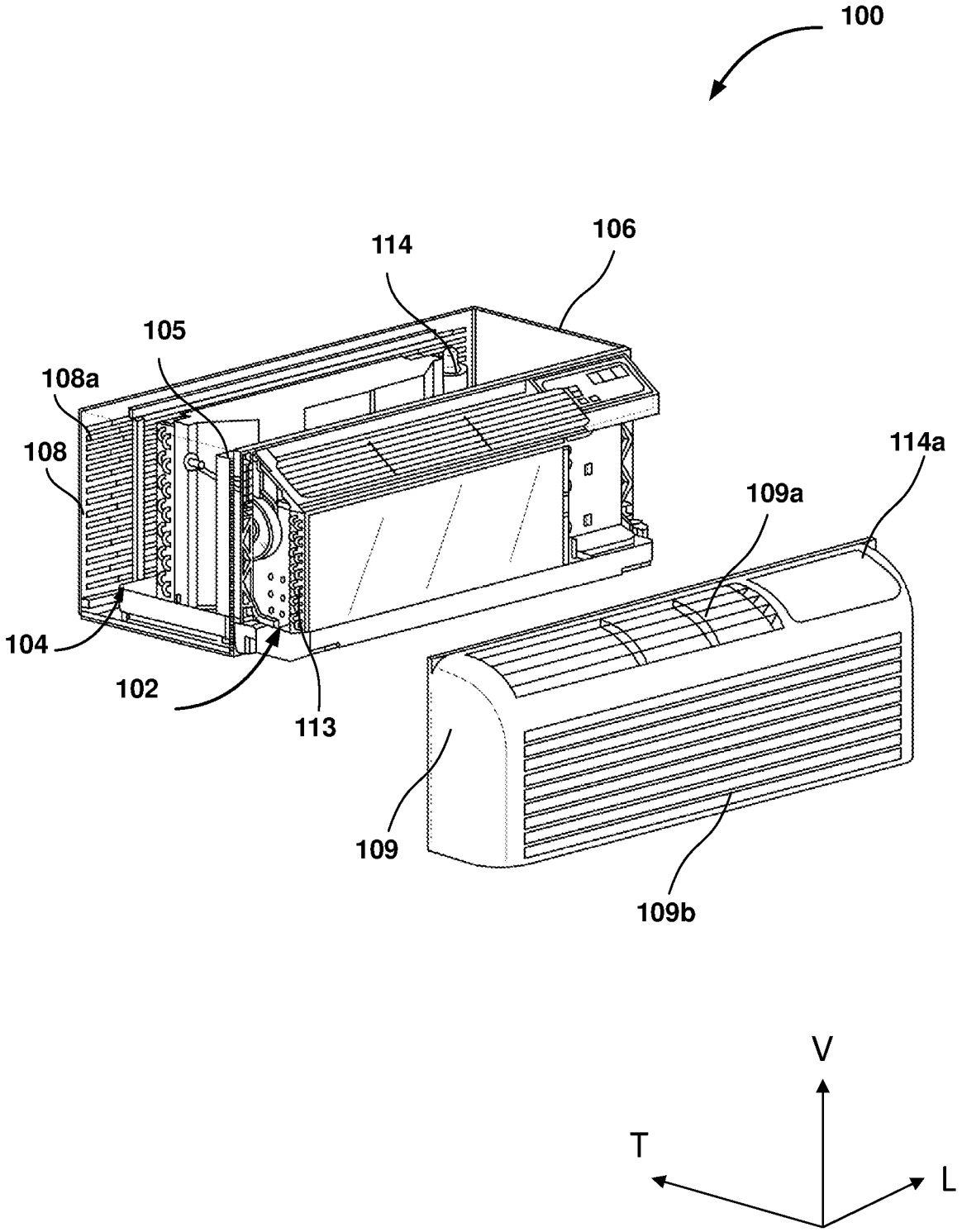
FIG. 1A (Prior Art)
FIGS. 1A-1C shows a typical prior art PTAC system.
Figure 1B:
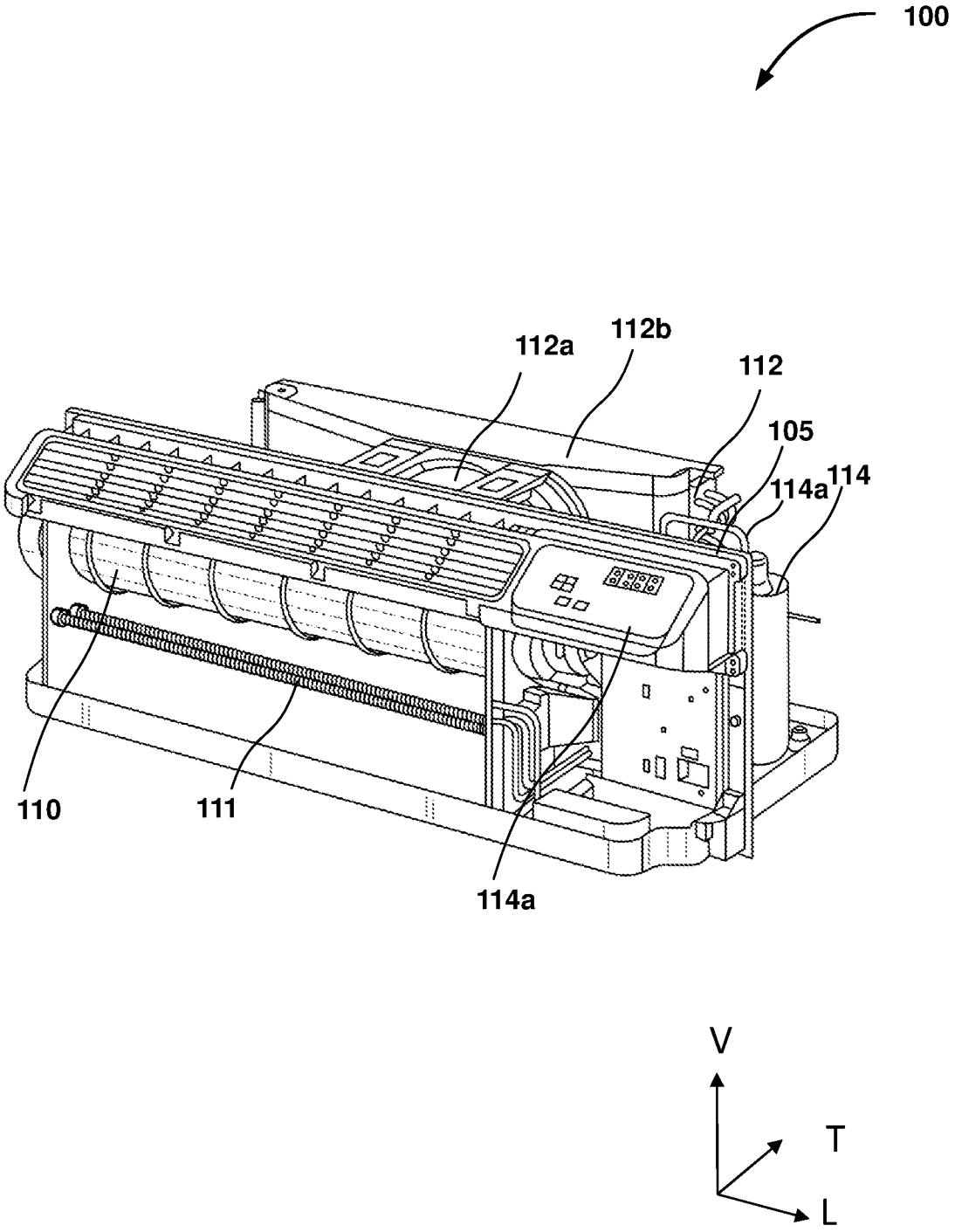
FIG. 1B (Prior Art)
Figure 1C:
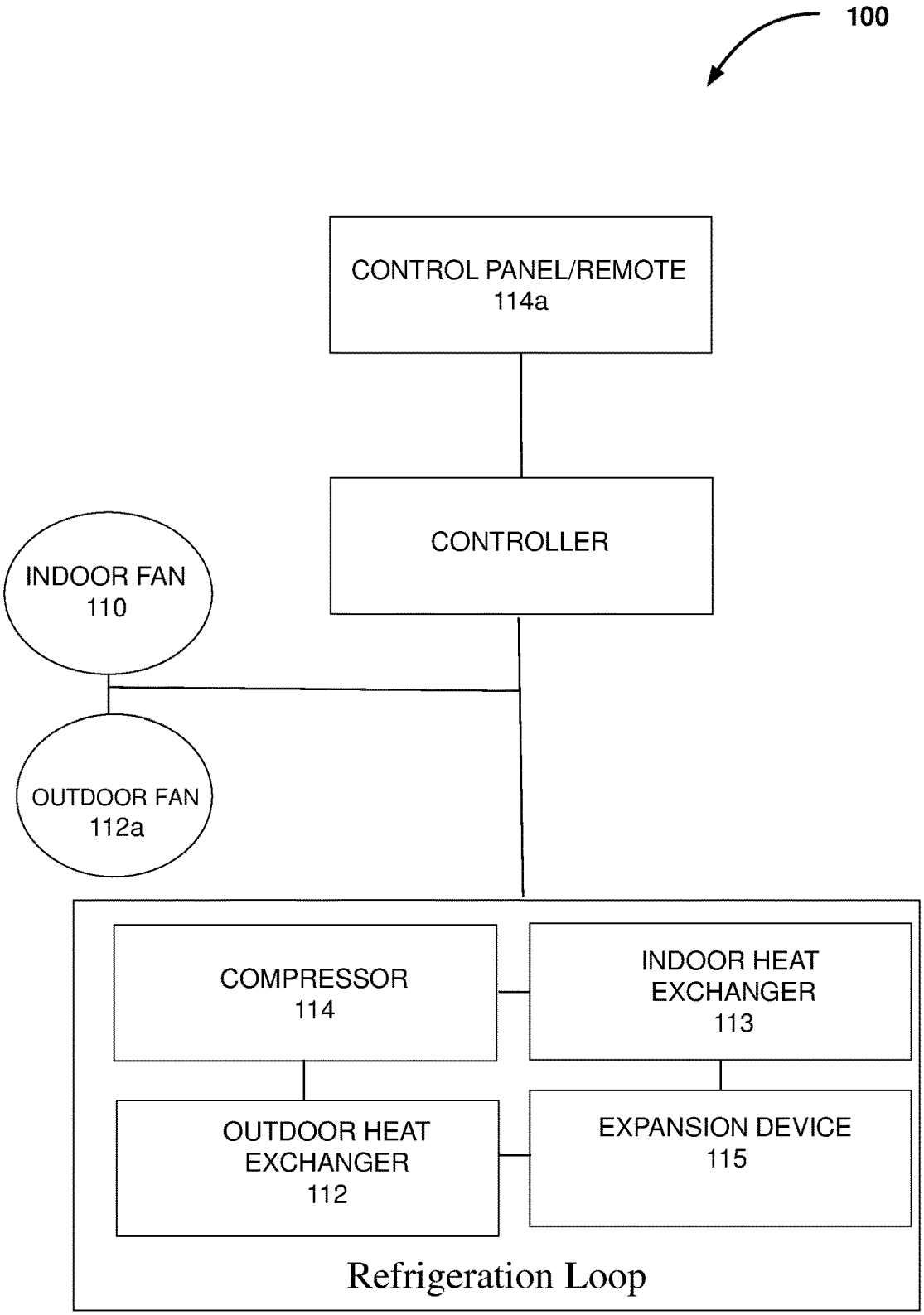
FIG. 1C (Prior Art)

Referring now to FIGS. 1A, 1B, and 1C, a typical traditional packaged terminal air conditioning (PTAC) unit 100 is shown. The PTAC unit 100 includes an indoor portion 102 and an outdoor portion 104 separated by an intermediate wall 105. The indoor portion 102 and the outdoor portion 104 generally define a vertical direction V, a lateral direction L, and a transverse direction T, all oriented perpendicular to each other.

A housing/sleeve 106 of the PTAC 100 may contain various other components, for example, a rear grill 108 as part of the outdoor portion 104, and a front panel 109 as part of the indoor portion 102. The rear grill 108 and the front panel cover 109 are disposed of in spaced-apart relation along the transverse direction T. The rear grill 108 consists of a plurality of uniform openings 108*a* to allow airflow therethrough.

The components of the outdoor portion 104, such as an outdoor heat exchanger 112, an outdoor fan 112*a*, and a compressor 114 may be housed within the housing/sleeve 106. The outdoor fan 112*a* is preferably a linear fan that pushes the air out from the outdoor portion 104 to the outside in the external environment. The outdoor fan 112*a* and the outdoor heat exchanger 112 are mounted in a spaced-apart relation long direction T. The compressor 114 is housed towards the lateral direction L with respect to the outdoor fan 112*a*. Particularly, the compressor 114 and associated fluid lines 114*a* are housed behind a control panel 114*a* (along direction T). The control panel 114*a* consists of one or more input buttons and display means as seen in FIG. 1B.

The indoor portion 102 may include, for example, an indoor heat exchanger 113, an indoor fan 110, and at least one heating unit 111. These components may be housed behind the front panel cover 109 of the PTAC. The intermediate wall 105 generally defines the indoor portion 102 and outdoor portion 104 and functions to separate them. As shown, in the conventional PTAC unit 100, the outdoor heat exchanger 112 is configured parallel to the indoor heat exchanger 113, and the outdoor fan 112*a* is located behind and in between the outdoor heat exchanger 112 and the intermediate wall 105. The fan 112*a* may be encased inside a casing 112*b*.

The PTAC system 100 also includes a refrigeration loop consisting of the outdoor and indoor heat exchangers 112, and 113, the compressor 114, and an expansion device 115. The compressor 114 and the expansion device 115 may be in fluid communication with the outdoor heat exchanger 112 and the indoor heat exchanger 113 for the flow of refrigerant (Eg. R410a) therethrough as known in the art. More particularly, the refrigeration loop may include various flow lines to allow the flow of refrigerant between the various components of the refrigeration loop. Refrigerant can flow through such lines from the indoor heat exchanger 113 to the compressor 114, from the compressor 114 to outdoor heat exchanger 112, from the outdoor heat exchanger 112 to the expansion device 115, and from the expansion device 115 to the indoor heat exchanger 113. The refrigerant may generally undergo phase changes associated with a refrigeration cycle as it flows to and through these various components, as is generally known in the art. The refrigeration loop may be operated in a cooling mode or a heating mode using the one or more buttons provided on the control panel 114*a* or using a remote-control device 114*a* (not shown) provided with the PTAC unit 100, depending upon which the indoor heat exchanger 113 may act as an evaporator and the outdoor heat exchanger 112 acts as a condenser or vice versa. As known in the art, the outdoor and indoor heat exchangers 112, and 113 include coils through which the refrigerant may flow for heat exchange purposes. The compressor 114 as used and preferred may be a variable speed compressor that may be operated at various speeds depending on the air conditioning need of the room and the demand of the refrigeration loop. The compressor 114 plays an important role in cooling or heating the outdoor air before sending it to the room and is operational all the time during the operation of the typical PTAC.

Depending upon the air conditioning command received from the room occupants, the number of room occupants, the size and sealing of the room, etc, the PTAC 100 functions to cool or heat the room to the desired level, and the compressor 114 remain operational all the time to meet the air conditioning requirement. The more air conditioning required, the more the compressor 114 has to work. The more compressor 114 is performing the work in order to heat or cool the room, the more power it consumes. This leads to being costly, especially with ever-increasing utility/electricity charges. Thus, there exists a desire for a solution that would lessen the workload on the compressor and thus decrease the overall power consumption of the PTAC 100.

The inventor herein has envisioned strategically integrating an ERV or HRV unit 300 within the housing/sleeve 106 of the PTAC 100 decreases the work done by the heat pump/compressor 114 and/or decrease the overall power consumption by the PTAC 100 which would otherwise be much more. Hereinafter the improved PTAC unit or PTAC system is referred to as 200. However, integration of the ERV or HRV unit 300 within the traditional PTAC system (as shown in FIG. 1A-1B) is a challenge in itself due to the unavailability of adequate space within the sleeve 106. In order to meet this requirement, the inventor herein proposes a new and improved configuration or placement for the outdoor heat exchanger 112, the outdoor fan 112*a*, and the compressor unit 114 and associated flow lines 114*a* (not seen) of the outdoor portion 104 within the housing/sleeve 106. This reconfiguration of the outdoor heat exchanger 112, the outdoor fan 112*a*, and the compressor unit 114 create an additional space 'S' within the sleeve 106 for housing the ERV or HRV unit 200 which are shown and described with respect to FIGS. 2-5.

The inclusion of ERV or HRV unit 300, in accordance with an exemplary embodiment, fulfils additional air conditioning requirements to keep the room appropriately cool or heated as desired. Referring to FIGS. 2-5, the sleeve/housing 106 is further provided with a backplate 202 connecting the sides of the sleeve 106. The plate 202 has a cut-out section 203 for mounting an outdoor fan 204 thereon. In an embodiment, the cut-out section 203 is circularly shaped. In another embodiment, the cut-out section 203 is square-shaped. The cut-out section 203 would depend on the shape of the outdoor fan 204. The outdoor fan 204 is preferably an exhaust fan able to suck/draw air from the outdoor portion 104 and throw it outside. In contrast to the positioning of the outdoor fan 112*a* in traditional PTAC unit 100, the outdoor fan 204 in the PTAC unit 200 is configured to get laid outside the external wall along the transverse direction T. The outdoor fan 204 is fitted along the cut-out section 203. Further, the backplate 202 includes an opening 205 for the outdoor fresh air to enter within the outdoor portion 204 (preferably in order to cool the compressor 114).

Figure 2:
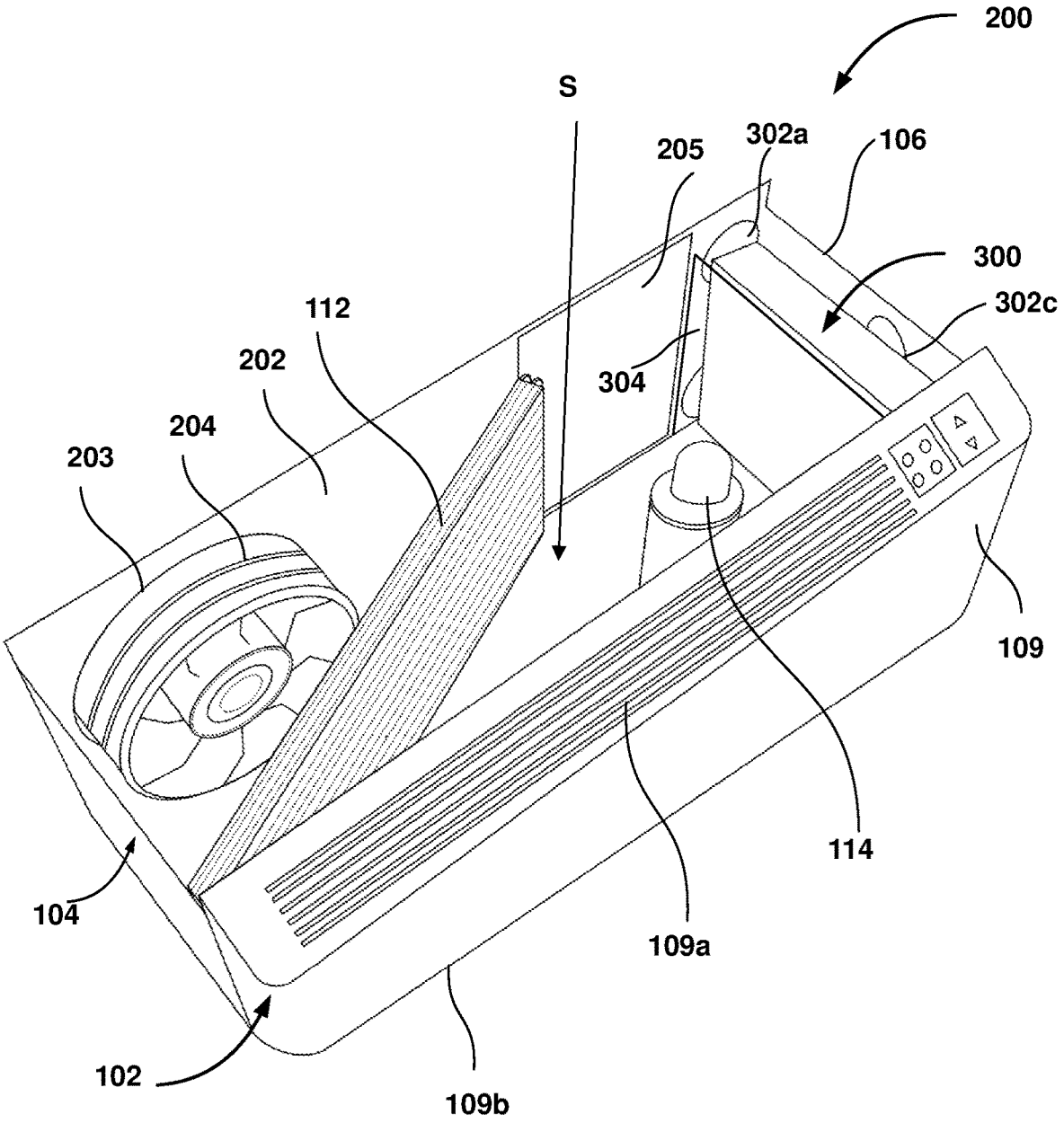
FIG. 2, FIG. 3 and FIG. 4 illustrate schematic diagrams for a novel configuration for a PTAC system with an integrated energy recovery ventilator (ERV) or heat recovery ventilator (HRV) unit, according to an exemplary embodiment.
Figure 3:
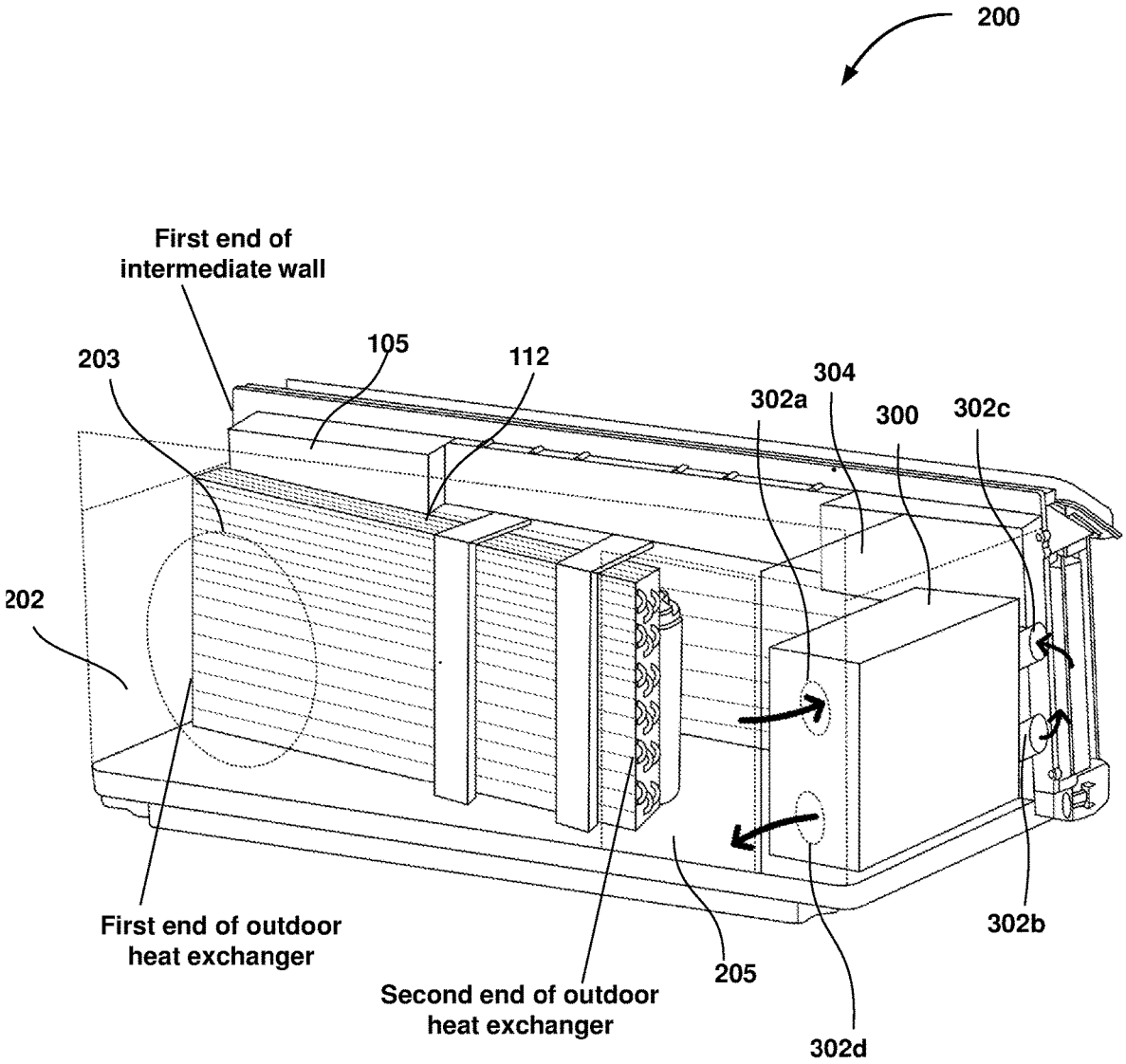
Figure 4:
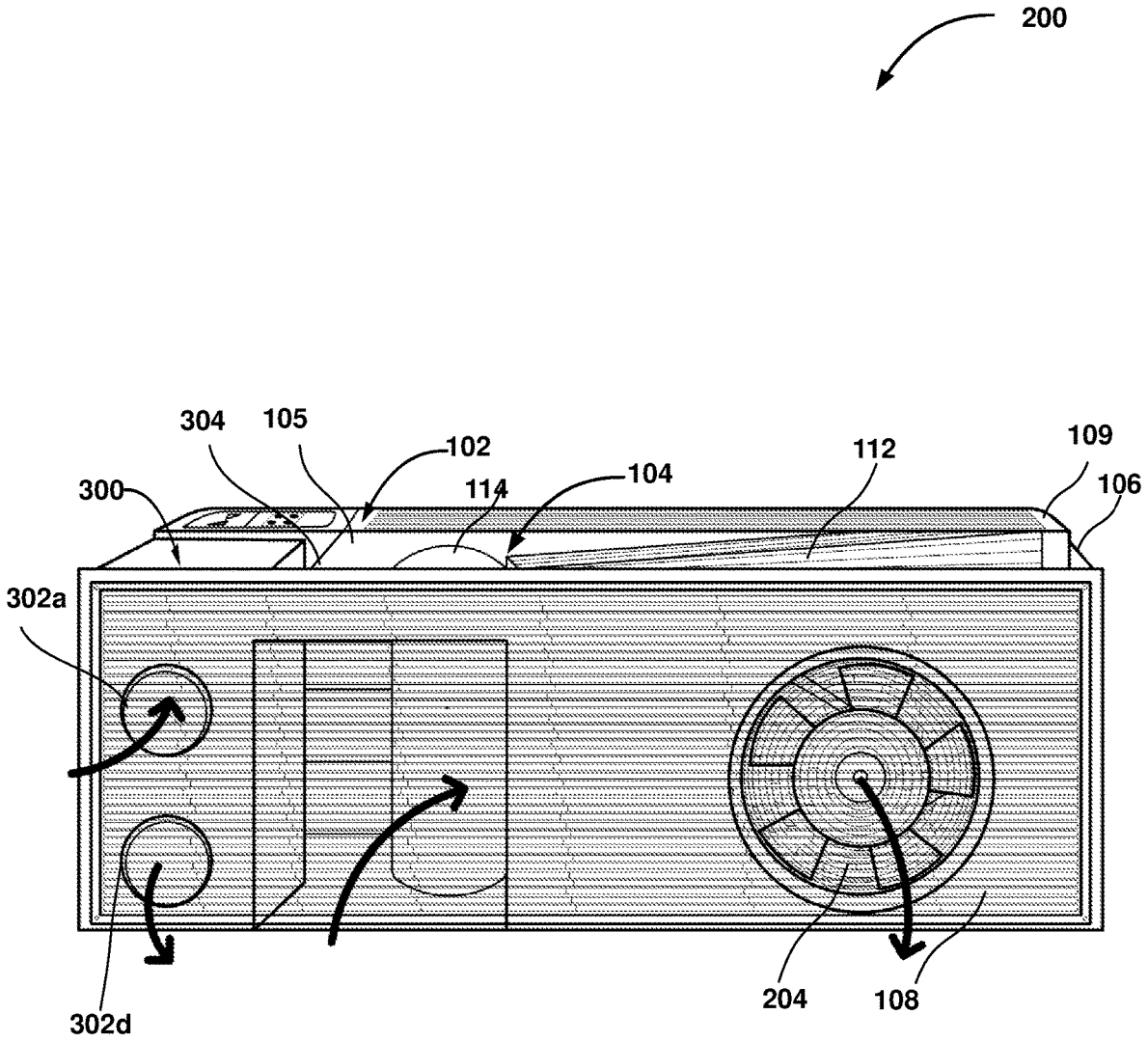
Figure 5:
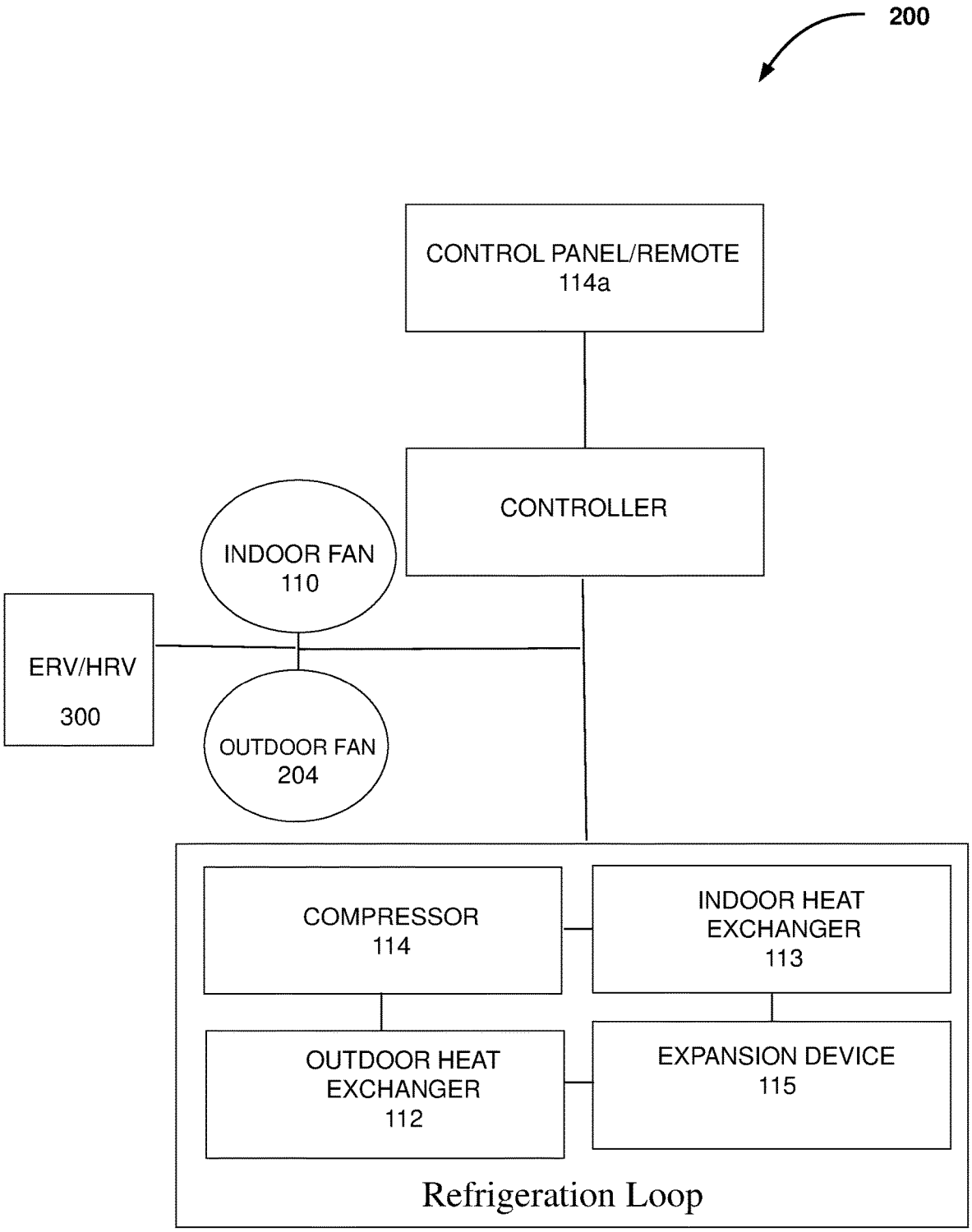
FIG. 5 shows a representative block diagram associated with the proposed novel PTAC system with integrated ERV, according to an exemplary embodiment.

Additionally, the outdoor heat exchanger 112 instead of being placed parallel to the indoor heat exchanger 113 or the intermediate wall 105 separating indoor and outdoor portions 102, 104 is configured at an angle or in a diagonal fashion as seen in FIG. 2. As seen, a first end of the outdoor heat exchanger 112 meets or at least laid proximal to the first end of the intermediate wall 105 and a second end of the outdoor heat exchanger 112 meets or at least laid proximal to the backplate 202 or the opening 205. In an example, the angle is 45 degrees, In some other embodiment, the angle is 60 degrees. In some other embodiments, the angle may range from 20 degrees to 60 degrees. The change of the positioning of the outdoor fan 204 and the angular orientation of the outdoor heat exchanger 112 creates an extra room or space 'S'. In the presented example, the compressor 114 is shown positioned in this space 'S'. Also, the flow lines that enable flow of refrigerant will also be preferably housed within this space 'S'. In other words, compressor 114 is positioned near the outdoor heat exchanger 112 in between the outdoor heat exchanger 112 and the intermediate wall 105.

As a result of the creation of space 'S' and relocation of the compressor 114 and associated flow lines 114*a* (not shown) within this space 'S', the original position where compressor 114 and flow lines 114*a* were originally mounted in the traditional PTAC 100 becomes vacant or remains unused which can then be utilized to mount/accommodate or house ERV/HRV unit 300. Further, according to the embodiment, the ERV/HRV unit 300 may be separated from the compressor 114 and associated flow lines 114*a* (not shown) using a separation wall 304 forming a part of the outdoor portion 104 or the sleeve 106. One skilled in the art should understand that ERV/HRV units are available in different sizes and even it is possible to customize the size of the ERV/HRV unit as required to fit into the vacant space which was otherwise occupied by the compressor 114 and associated flow lines 114*a* in the traditional PTACs.

For the purpose of this disclosure, it has been assumed that the functioning of the ERV/HRV unit 300 is well-known in the art, and thus, the same will be described in brief herein. As known, any ERV/HRV unit 300 includes a core (not seen), inlets 302*a*,302*c*, outlets 302*b*,302*d*. Stale air from the room being conditioned passes through inlet 302*c* (via stale air inlets 109*b* of the PTAC 100) into the core. Once through the core, it is passed to an exhaust outlet 302*d*. According to an embodiment, the stale air inlets 109*b* may be positioned at the bottom of the indoor portion 102 or front cover 109 as seen in FIG. 2. In another embodiment, the stale air inlets 109*b* may be positioned on the front side of the indoor portion 102 or front cover as shown in FIG. 1A. Fresh air enters unit 300 through fresh air inlet 302*a* and passes through the core. Fresh air is exhausted from unit 300 through the fresh air outlet 302*b* and then reaches the room (via slits/openings 109*a*) that require air conditioning. This air exhausting through the fresh air outlet 302*b* passes through the indoor fan/blower fan 110 of the indoor portion 102 of PTAC 200. Typically, the ERV/HRV unit 300 also houses two fans, one for the fresh air flow through (referred to as "outside air intake fan") and the other for the exhaust airflow through the unit 300 (referred to as "inside air exhaust fan).

During the normal course of operation, the amount of air conditioning happening inside the room/living space is dependent upon the number of occupants, room size, command, etc. The occupant may command the PTAC 200 to increase or decrease the cooling or heating effect. At any instance, in order to meet the room conditioning requirement of the room, the ERV/HRV unit 300 is put in operational mode (besides working compressor 114) via using buttons provided on the control panel or the remote 114*a*. The operation of the ERV/HRV unit 300 will ensure less working load on the compressor 114 present in the PTAC 200 thus reducing overall power and power consumption cost. This is because ERV/HRV unit 300 preheats or precools the outdoor air by passing through the core before letting it go into the room for air conditioning. The operation of ERV/HRV 300 may be manually triggered or auto-triggered according to the embodiment of the present invention. The operation of ERV/HRV 300 may be triggered using one or more buttons on the control panel or the remote-control device 114*a*. In some other embodiment, the ERV/HRV's operation and/or PTAC's operation may be controlled using a smartphone (or similar devices) having a program product installed therein that would enable the smartphone to communicate with the PTAC and the ERV/HRV unit.

Further although not described in detail, the PTAC system houses electronic circuitry comprising of controller/processor and other known components the functions of which are not covered herein to keep the disclosure concise.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the present invention.

What is claimed is:

1. A packaged terminal air conditioner (PTAC) system (200), comprising:

an indoor portion (102);

an outdoor portion (104) embodied inside a sleeve (106), the outdoor portion (104) comprising at least a backplate (202) with a cut-out section (203), an outdoor fan (204) mounted on the cut-out section 203, an outdoor heat exchanger (112) configured at an angle with a first end associated thereof laid proximal to a first end of an intermediate wall (105) separating an indoor portion (102) and the outdoor portion (104), and a second end associated thereof laid proximal to the backplate (202);

a compressor (114) and associated refrigerant flow lines (114*a*), and an ERV/HRV unit (300);

wherein the angular placement of the outdoor heat exchanger (112), and the backplate-mounted outdoor fan (204) leaves a space(S) within the outdoor portion (104);

wherein the compressor (114) and associated refrigerant flow lines (114*a*) are positioned within the space (S), wherein the space(S) further facilitates in accommodation of the ERV/HRV unit (300) within the outdoor portion (104); and wherein the integration of the ERV/HRV unit (300) within the outdoor portion (104) ensures lowering of the workload of the compressor (114) by preheating or precooling the outdoor air entering a room by passing through a core embodied there inside to cool or heat a living space, thereby reducing the overall power consumption of the PTAC system (200).

2. The PTAC system (200) of claim 1 further comprising a rear grill (108) with a plurality of openings (108*a*).

3. The PTAC system (200) of claim 1, wherein the outdoor fan (204) is an exhaust fan able to draw air from the outdoor portion (104) and pushes the air outside.

4. The PTAC system (200) of claim 1, wherein the angle may range from 20 degrees to 60 degrees.

5. The PTAC system (200) of claim 1, wherein the indoor portion (102) comprising a front cover (109) adapted for concealing at least an indoor heat exchanger (113), an indoor fan (110), and a heating element (111) located in the indoor portion (102).

6. The PTAC system (200) of claim 1, wherein the compressor 114 and associated flow lines (114*a*) are positioned in between the outdoor heat exchanger (112) and the intermediate wall (105).

7. The PTAC system (200) of claim 1, the outdoor portion (104) comprises a separation wall (304) separating the ERV/HRV unit (300) from the compressor (114) and associated flow lines (114*a*).

8. The PTAC system (200) of claim 1, wherein the ERV/HRV unit (300) is operational along with the compressor (114) in order to adjust the air conditioning requirement of the room.

9. The PTAC system (200) of claim 1, wherein the cut-out section (203) is circularly shaped.

10. The PTAC system (200) of claim 1, wherein the backplate (202) comprises an opening (205) to allow outdoor fresh air to enter within the outdoor portion (204).

11. The PTAC system (200) of claim 10, wherein the outdoor fresh air entering within the outdoor portion (204) through the opening (205) cools the compressor (114).

* * * * *